US005108149A

United States Patent [19]

Ambasz

[11] Patent Number: 5,108,149

[45] Date of Patent: Apr. 28, 1992

[54] ADJUSTABLE SEATING

[75] Inventor: Emilio Ambasz, New York, N.Y.

[73] Assignee: Center for Design Research and Development N.V, Curacao, Netherlands

[21] Appl. No.: 608,201

[22] Filed: Nov. 2, 1990

Related U.S. Application Data

[63] Continuation-in-part of Ser. No. 436,490, Nov. 14, 1989, abandoned.

[51] Int. Cl.[5] ..... A47C 1/032

[52] U.S. Cl. ..... 297/342; 297/297; 297/306

[58] Field of Search ..... 297/296, 297, 300, 306, 297/317, 343, 353

[56] References Cited

U.S. PATENT DOCUMENTS

| | | | |
|---|---|---|---|
| 3,567,280 | 3/1971 | Bradshaw | 297/318 |
| 4,084,850 | 4/1978 | Ambasz | 297/300 |
| 4,131,260 | 12/1978 | Ambasz | 297/326 |
| 4,157,203 | 6/1979 | Ambasz | 297/304 |
| 4,362,336 | 12/1982 | Zapf et al. | 297/317 |

FOREIGN PATENT DOCUMENTS

| | | | |
|---|---|---|---|
| 852467 | 2/1940 | France | 297/341 |
| 7316482 | 11/1973 | Netherlands . | |
| 665375 | 1/1952 | United Kingdom | 297/343 |

*Primary Examiner*—Kenneth J. Dorner
*Assistant Examiner*—Cassandra Hope
*Attorney, Agent, or Firm*—Brumbaugh, Graves, Donohue & Raymond

[57] ABSTRACT

Adjustable seating comprises a frame having a seat-supporting portion and a back-supporting portion, a seat bottom mounted on the seat-supporting portion for movement between rearward and forward positions and a seat back mounted on the back-supporting portion by at least one resilient articulating linkage for tilting movement independently of the position of the seat bottom. The seat back is connected to the seat bottom by a flexible but non-extensible coupling member and is slidable up and down on an upper linkage member of the articulating mechanism so that when the seat bottom moves forwardly or backwardly, the seat back moves downwardly or upwardly, respectively, in correspondence with the movements of the seat bottom. A configuration control spring biases the seat back/bottom to an upward/rearward configuration.

16 Claims, 7 Drawing Sheets

ADJUSTABLE SEATING

This is a continuation-in-part of U.S. patent application Ser. No. 07/436,490 filed Nov. 14, 1989, now abandoned.

BACKGROUND OF THE INVENTION

U.S. Pat. Nos. 3,982,785 (Ambasz, Sep. 28, 1976) and 4,084,850 (Ambasz, Apr. 18, 1978) describe and show chairs in which the seat bottom slides forward from a resiliently restrained rearward position and the seat back tilts rearwardly from a resiliently restrained upright position, the seat and back movements being entirely independent and being produced automatically when the person sitting in the chair changes position from an upright posture to a reclining posture. The inventions of those patents have been very successfully commercialized as the well-known "Vertebra ®" seating made under license and sold in many parts of the world. The "Vertebra ®" line includes institutional and office models including four-legged unupholstered chairs with and without arms, tandem seating, lightly upholstered operational chairs, and more heavily upholstered managerial and executive desk and side chairs. All models have essentially the same seat frame based on parallel side tubes connected by a cross-piece, a seat bottom having sleeves on either side that are received telescopically and slidably on cantilevered front parts of the side tubes and a seat back connected to the upright back-supporting parts of the side tubes by resilient, articulated linkages. The "Vertebra ®" chairs are renowned especially for providing optimal body weight distribution and excellent sacro-lumbar support and for their ability to change position automatically according to the sitting posture assumed by the user.

When a person sitting in a "Vertebra ®" chair shifts between an upright posture and a somewhat reclined posture (leaning back) and the seat bottom slides forward or backward, the person's back has to slide up or down the seat back, which can cause pulling and rumpling of clothing and can at times be bothersome. Also, in the reclined position, the person's back is supported in a higher part than it is in an upright position, and the lumbar region is, therefore, not as well supported in the reclined position.

SUMMARY OF THE INVENTION

One object of the present invention is to minimize the pulling and rumpling of clothing and the occasionally bothersome sliding of the person's back up and down the seat back in seating of the "Vertebra ®" type. Another object is to provide adjustable seating in which the lumbar portion of the anatomical back is supported optimally in all seating postures. Still another object is to provide improvements in the "Vertebra ®" chairs that requires few changes in the components and mechanisms that have proven to be highly effective and reliable by long experience with the many hundreds of thousands of "Vertebra ®" chairs that are now in use.

The foregoing objects are attained, according to the present invention, by adjustable seating having a frame that includes a seat-supporting portion and a back-supporting portion, a seat bottom mounted on the seat-supporting portion for sliding movement between rearward and forward positions, and a seat back mounted on the back-supporting portion by at least one resilient articulating linkage for tilting movement independently of the position of the seat bottom between a resiliently restrained upright position and a tilted-back position. The invention is characterized in that the seat back is mounted on an upper linkage member of the resilient articulating linkage to slide up and down relative to the back-supporting portion of the seat frame, in that a bendable but substantially non-extensible coupling member connects the seat back to the seat bottom, in that the coupling member is constrained to follow a predetermined path from the seat back to the seat bottom, and in that a configuration control spring compressed between the seat back and the back-supporting member yieldably biases the seat back to an upward position and in so doing yieldably biases the seat bottom to its rearward position by means of the coupling member, whereby when the seat bottom is moved forwardly or rearwardly, the seat back moves downwardly or upwardly in correspondence with the seat bottom movements.

In preferred embodiments the seat back includes a downwardly opening socket receiving the upper linkage member of the resilient articulating linkage, and the upper linkage member is tubular and is received in the socket in sliding and guiding relation. The configuration control spring is received within the socket and the upper linkage member and is compressed between a shoulder in the top of the socket and a spring retainer number received within the upper linkage member. A spring guide member receives a portion of the configuration control spring and keeps it from deflecting out against the wall of the upper linkage member. Preferably, a metal reinforcing member is received within the socket of the seat back. Also, it is desirable to interpose an anti-friction sleeve of a polymeric material between the reinforcing member and the upper linkage member. According to one preferred embodiment, a reinforcing tube is affixed to the inside of the socket in the seat back, an anti-friction sleeve is affixed within the tube, and the sleeve is attached to the coupling member. Preferably, the seat-supporting and back-supporting positions of the frame are parts of a frame side member that is generally L-shaped in lateral profile, and the coupling member is tubular and is slidably received over the frame side member such that the frame side member constrains it to a predetermined path of movement.

According to another aspect of the invention a first stop establishes a rearward-most/uppermost position of the seat bottom/back and a second stop establishes a forward-most/lowermost position of the seat bottom/-back.

In an embodiment of the present invention a tubular upper linkage member has a lower edge seated on the upper edge of a lower linkage member, the lower end of coupling rod is pivotally attached to the lower linkage member and extends upwardly within the upper linkage member, the upper end of a coupling rod is connected to a spring abutment member, and an articulation control spring is compressed between the abutment member and a shoulder on the upper linkage member below the abutment member so as to yieldably bias the lower edge of the upper linkage member against the upper edge of the lower linkage member and thereby restrain the seat back in an upright position. The lower end of the configuration control spring acts against the back-supporting portion of the frame via the spring abutment and coupling rod.

According to another aspect of the invention there is a device for selectively and releasably coupling the seat bottom to the frame in either its rearward position or its forward position such as to establish a fixed configuration of the seat bottom and seat back on the frame. For example, the seat bottom coupling device may include an abutment on the underside of the seat component and a movable latch member on the frame movable to engage either a front edge on a rear edge of the abutment.

A chair according to the invention provides automatic adjustment of its configuration to provide optimal support for the person sitting in it throughout a range of sitting postures between upright and considerably reclined. For a fully upright posture the seat back resides in an upright position, in which it is restrained by the resilient articulating linkage, and the seat back and seat bottom are in their upwardmost and rearward-most positions, in which they are restrained by the configuration control spring. In the upright configuration the user may arch his or her back against the seat back, which yields and tilts rearwardly by articulation of the articulating mechanism. By applying forward pressure on the seat bottom, the seat bottom slides forwardly, which simultaneously and automatically pulls the seat back downwardly against the restraining force of the configuration control spring. In this configuration the sitter is comfortably supported in a slumped-down position; support for the sitter's back is optimal, in that the seat back has moved down to conform to the slumped position. In changing from the upright to the slumped position, the chair seat back and seat bottom move together, so there is no pulling of the clothing or sliding movement of the persons body relative to the chair. In the slumped configuration of the chair the back may remain upright or may be tilted back, depending on the sitting posture assumed by the sitter. In the rearwardly-tilted position the chair comfortably accommodates a reclined sitting posture. The accommodation of the chair seat and back to a whole range of sitting postures by automatic adjustment of the configuration by various combinations of articulation of the seat back and coordinated movements of the seat back/bottom between upward/rearward and downward/forward positions provides remarkable comfort and support, which reduces fatigue and is ergonomically ideal for meeting one's need for a variety of sitting postures in which to perform a range of office work tasks or simply to sit for a period of time, such as in a conference room, waiting room, class room or other institutional setting. When combined with a tilt mechanism, which allows the chair to tilt forward and backward as a whole, the range of sitting postures is increased significantly.

For a better understanding of the invention, reference may be made to the following description of an exemplary embodiment, taken in conjunction with the accompanying drawings.

DESCRIPTION OF THE EMBODIMENT

Figure 1:
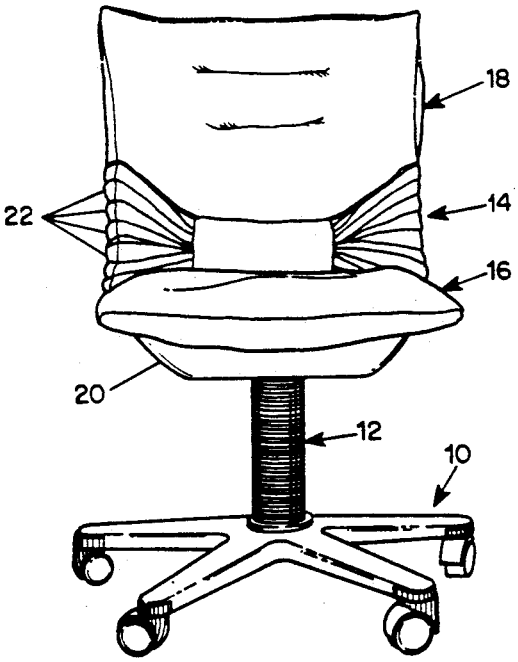
FIGS. 1 to 4 are front, side, rear and three-quarter side pictorial views, respectively, of an armless, fully upholstered side chair embodying the present invention.
Figure 2:
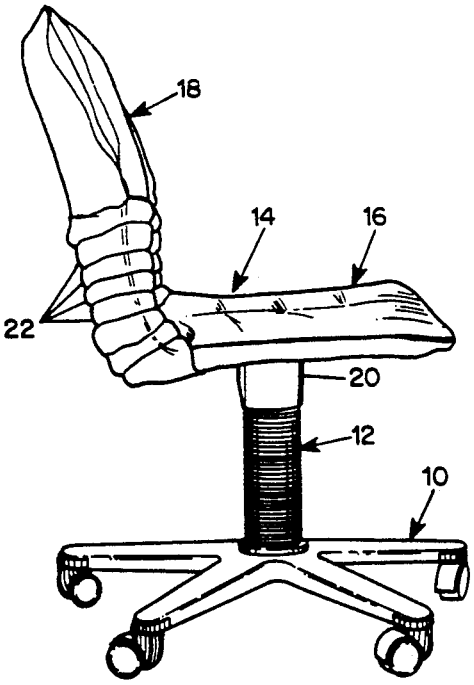
Figure 3:
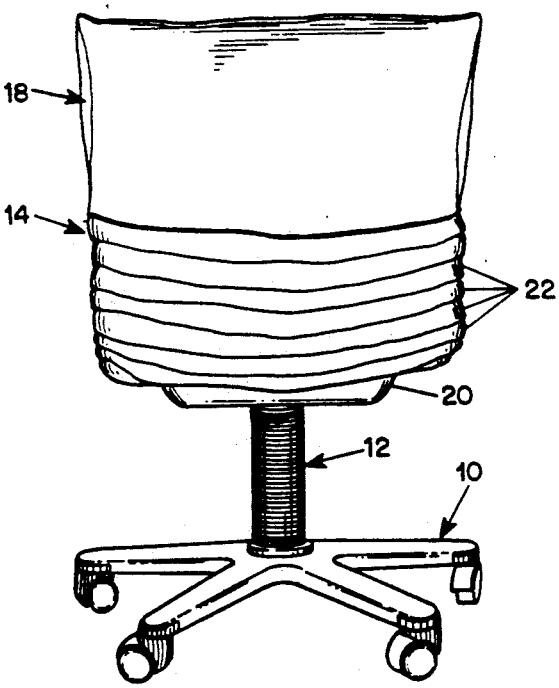
Figure 4:
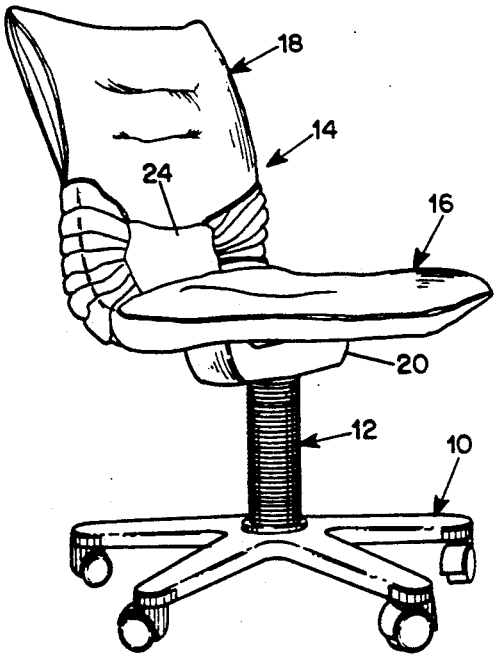
Figure 5:
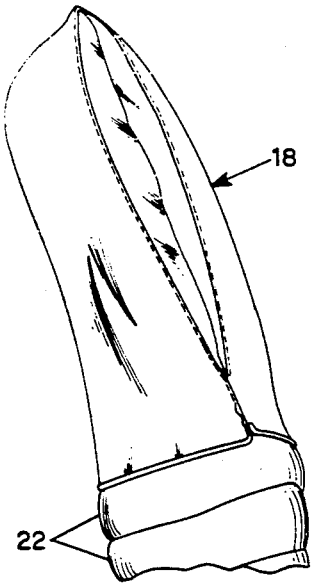
FIG. 5 is a detail side pictorial view of the upper part of the seat back.

Because the forward and backward movements of the seat bottom and the down and up movements of the seat back are coordinated, it is possible to fully upholster the chair, as shown in FIGS. 1 to 5. In the "Vertebra ®" chairs the seat bottom moves forward and backward while the seat back is vertically fixed, and it is impractical to provide full upholstery. The chair of FIGS. 1 to 5 is suitable for an executive or managerial office side chair. It has a five-legged, castered pedestal base 10, a support column 12 (which may have a mechanical or gas spring height adjustment feature) and a seat 14 having a bottom 16 and a back 18. The seat 14 is mounted on the column 12 by a tilt mechanism (not visible) that is built into and concealed by a channel-shaped structural cross-member 20. The cross member and tilt mechanism are currently used in several models of the "Vertebra ®" chairs and are described and shown in U.S. Pat. No. 4,131,260, (Ambasz, Dec. 26, 1978).

The upholstery has a series of horizontally oriented, side-by-side tufts 22 formed by cross-wise stitching along the lower part of the back. The tufts 22 extend along the entire rear part of the lower seat back and turn around each lower side of the back and extend part way across the front, where they are gathered somewhat vertically (see FIG. 1) at a juncture with the sides of a small plain front panel 24. The tufts 22 allow the upholstery to perform with movements of the seat along the curved juncture of the bottom and back and also allow a single panel of the upholstery material (e.g., fabric, leatherette or leather) to form both the vertically longer rear expanse and the vertically shorter front expanse of the upholstery at the transition from the seat bottom to the seat back. The tufts, moreover, provide a unique and distinctive appearance. As described below, the seat and back are fully cushioned.

While FIGS. 1 to 5 show a particular form of upholstered chair, the present invention is entirely and easily applicable to other forms of full upholstery, to unupholstered seating and to seating in which the seat bottom and seat back are separately upholstered. like the various models of "Vertebra ®" seating are. Also, arms can be added by attaching them to each end of the cross-member 20, also as in some models of "Vertebra ®" chairs. The invention can be applied to four-legged chairs with and without arms, tandem seating, and various special applications, as has been done in the "Vertebra ®" line.

Figure 6A:
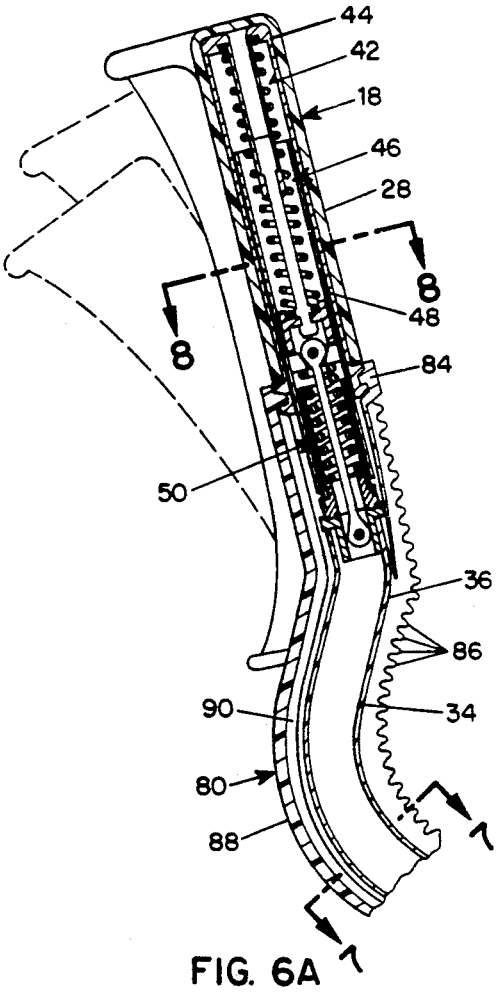
FIGS. 6A and 6B together make up a side cross-sectional view of the embodiment taken along the axis of the right side frame tube.
Figure 6B:
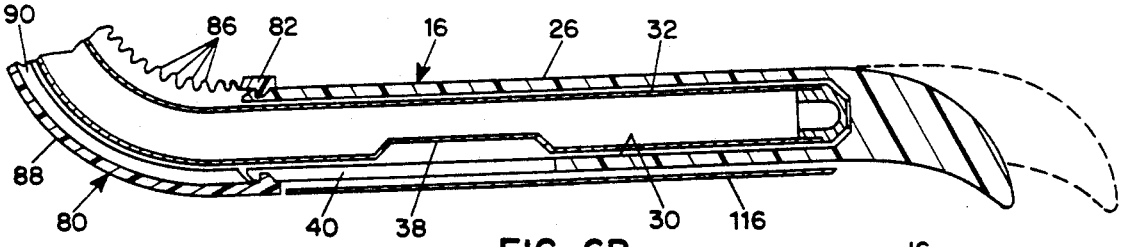
Figure 8:
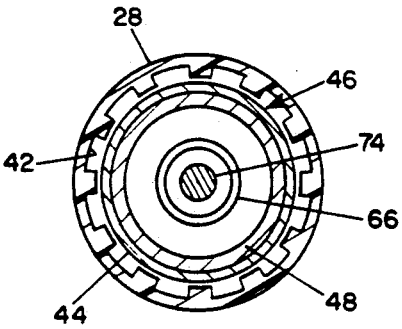

Unadorned by full upholstery, the chairs of the present invention look very much like "Vertebra ®" chairs. Moreover, the chairs of the embodiment use many of the components used in the "Vertebra ®" chairs. U.S. Pat. No. 4,084,850 (Ambasz, Apr. 18, 1978) is, therefore, hereby expressly incorporated by this reference to it into the present specification. In the embodiment the seat bottom 16 and seat back 18 are based on a bottom component 26 and a back component 28, each of which is molded from a rigid, durable polymeric material (see FIGS. 6A and 6B). The seat bottom component 26 has along the underside of each side edge a socket 30 that is open at its back end and receives a seat-supporting portion 32 of a frame side tube 34 in telescoping relation. Each frame side tube 34 is generally L-shaped in lateral profile, bending upwardly at the rear of the seat-supporting portion to provide a back-supporting portion 36. The side frame tubes 34 are welded to the respective ends of the cross member 20, the flattened area 38 (FIG. 6B) being the site of the welded juncture. The sockets 30 of the bottom component 26 have slots 40 generally on the undersides of the rear portions to accept the ends of the cross member 20. But for the configuration control spring mechanism described below, the seat bottom component 26 slides quite freely forward and backward by virtue of the telescoping relation of the socket 30 and the seat-supporting portion 32 of the side frame tube.

Figure 12:
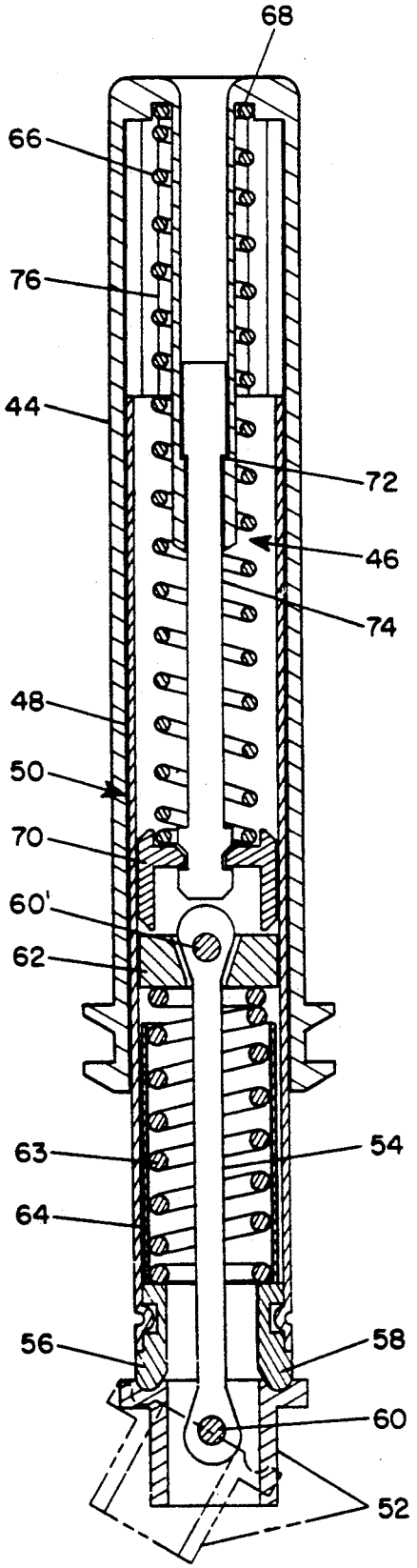
FIG. 12 is a side cross-sectional view of the resilient articulating mechanism and the configuration control spring mechanism on a larger scale than FIGS. 6A and 6B, the mechanisms being in the configurations they assume when the seat back is upright and in its uppermost position.
Figure 13:
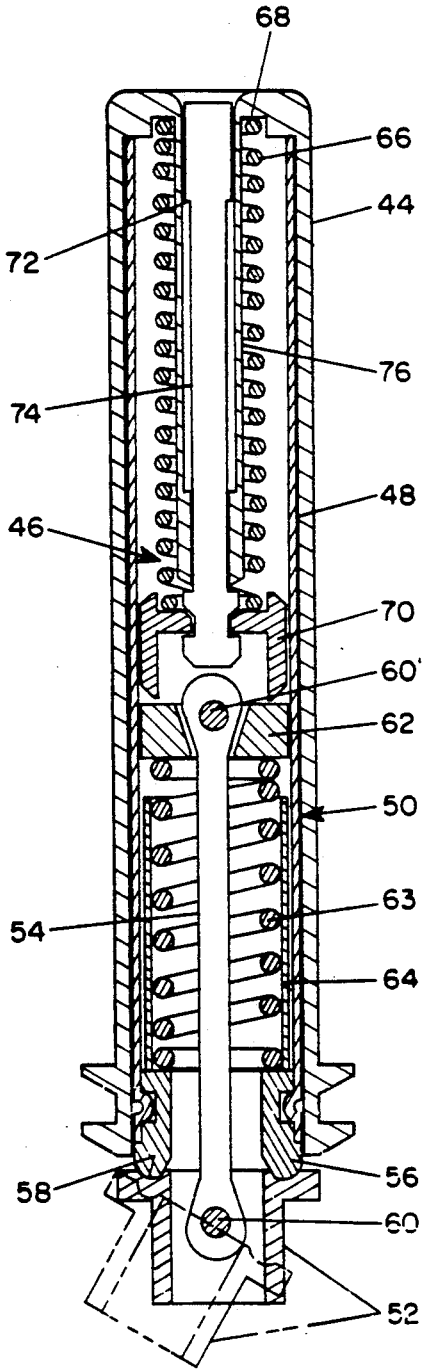
FIG. 13 is also a side-cross sectional view of the articulating mechanism and the configuration control spring mechanism, but shows them in the position they assume when the seat back is in its lowermost position.

The seat back component 28 has at each side a socket 42 that opens downwardly. Each socket 42 receives the tubular casing 44 of a configuration control spring mechanism 46, which in turn is received by the upper tubular linkage member 48 of a resilient articulating linkage 50. The configuration control spring mechanism 46 and linkage 50 are best seen in FIGS. 12 and 13.

The linkage 50, which mounts the seat back component 28 on the back-supporting portion 36 of each of the two frame side tubes 34, is very similar to the mechanism of FIGS. 18 or 19 of the Ambasz '850 patent. A lower tubular linkage member 52 fits within the open upper end of each frame side tube 34 and is suitably fastened in place, such as by rivets (not shown). The lower end of a coupling rod 54 is pivotally connected by a pivot pin 60 to the member 52. The upper tubular linkage member 48 has a tubular fitting 56 crimped onto its lower end that seats in a circular groove 58 in the upper edge of the lower linkage member 52. The upper end of the coupling rod 54 is pivotally connected by a pivot pin 60' to a spring abutment member 62 that is slidably received within the upper linkage member 48. A articulation control spring 63 is received under compression bias between the compression coil member 62 and the fitting 56. The spring force holds the fitting 56 seated in the groove 58 but yields to a rearward force against the seat back 18 exerted by the person sitting in the chair and allows the seat back to tilt rearwardly, the rear part of the circular groove 58 being the fulcrum about which the seat back pivots. The extent of rearward tilting is limited by a stop tube 64 received within the lower portion of the upper linkage member 48 and bearing at its lower edge against the fitting 56; when the underside of the abutment member 62 engages the upper edge of the stop tube 64, the force of the sitter's back that caused the seat back to tilt rearwardly is no longer applied, the force of the articulation control spring 63, which always seeks to keep the fitting 56 fully seated in the groove (prevent it from unseating), pushes the fitting back into seated relation, thereby restoring the seat back 18 to the upright position.

The tubular casing 44 of the spring mechanism 46 is received within and suitably fastened to the socket 42 the seat back component 28 and slidably receives telescopically the upper linkage member 48 of the articulating linkage 50. The casing is made of metal and reinforces the socket 42. A configuration control compression coil spring 66 is received within the casing 44 under compression bias between an upper shoulder 68 of the casing 44 and a spring retainer member 70 that bears against the abutment member 62 of the articulating linkage 50. Because the coupling rod 54 is connected to the frame side tube 34 (pin 60) and the abutment member 62 (pin 60') and transmits forces between the abutment member and the frame side tube, the configuration control spring 66 biases the seat back 18 upwardly with respect to the frame tube. The maximum extent of upward movement of the seat back 18 (and the casing 44 to which it is affixed) is limited by engagement of shoulders 72 on a stop rod 74 connected at its lower end to the retainer member 70 and a stop tube 76 connected at its upper end to the casing 44. Observe that the bias of the configuration control spring 66 is absorbed by the stop rod and stop tube when the shoulders 72 engage; this feature makes it possible to build the configuration control spring mechanism 46 and the articulating linkage 50 as a self-contained sub-assembly and facilitates assembly of the chair. It also prevents the bias of the configuration control spring 66 from constantly tending to push the seat back upwardly and pull the seat bottom rearwardly. If these two functions of the stop rod and stop tube are not desired, the stop rod and stop tube can be omitted. The stop rod and stop tube also restrain the spring 66 laterally against deflection into engagement with the inside wall of the upper linkage member, a function that can be fulfilled by a spring guide member, as described below.

Figure 7:
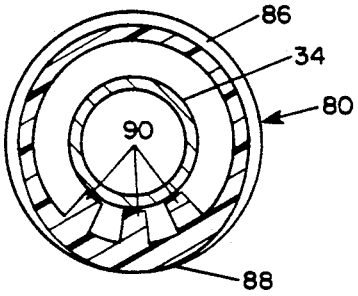
FIGS. 7 and 8 are enlarged transverse cross-sectional views taken along lines 7—7 and 8—8 of FIGS. 6A and 6B.

The seat bottom 16 and seat back 18 are connected by bendable but substantially non-extensible coupling members 80 that are constrained to follow a predetermined path between their points of connection to the seat bottom and seat back. In the embodiment (see FIGS. 6A and 6B) the coupling members 80 are tubular members that fit over the two side frame members. One end 82 of each coupling member is connected, such as by the snap-on coupling arrangement shown (FIG. 6B), to the rearward end of the seat bottom sleeve 30, and the other end 84 is similarly fastened to the lower end of the casing 44. The coupling member 80 is molded from a suitable polymeric material and includes along its length transverse corrugations or bellows-like portions 86 along the front and sides and a plain lengthwise band 88 with lengthwise internal ribs 90 along its rear portion (see FIG. 7). The corrugations 86 impart flexibility and the band 88 and ribs 90 non-extensibility. The inward edges of the ribs 90 also provide relatively low-friction land areas in engagement with the frame side tube 34.

When the person sitting in the chair applies a forward force on the seat bottom 16 by pressing his or her back against the seat back 18 and using the legs to slide the buttocks forward, the seat bottom slides forward, pulling the coupling members 80 with it, and the coupling members in turn pull the seat back downwardly against the forces of the configuration control spring mechanisms 46.

Figure 11A:
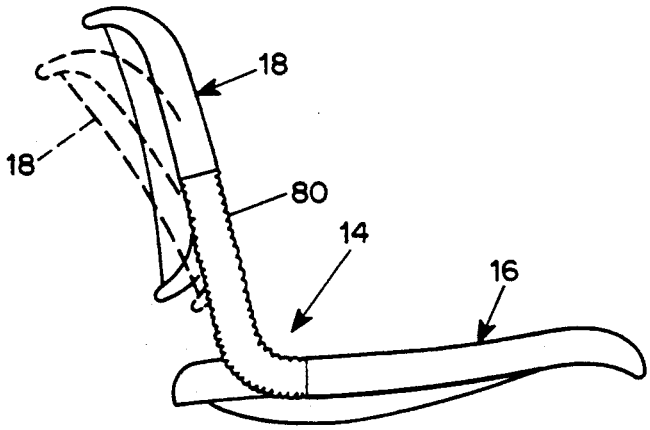
FIGS. 11A to 11C are side views in diagrammatic form showing the movements of the seat bottom and seat back.
Figure 11B:
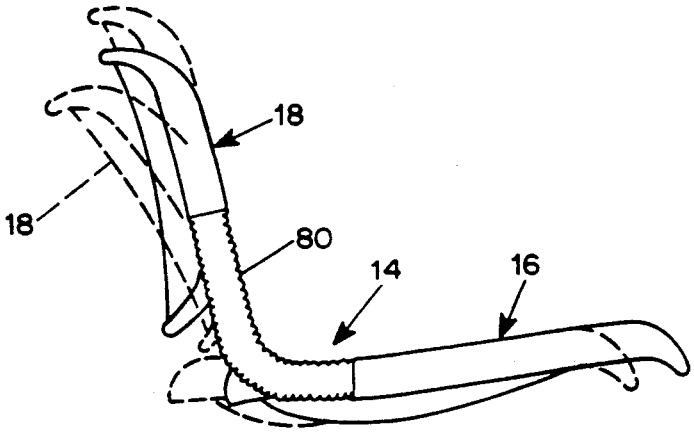
Figure 11C:
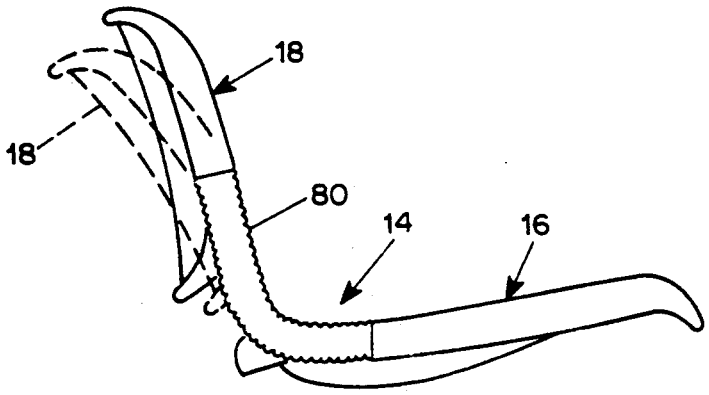

All of the adjustments of the chair seat are illustrated in FIG. 11. The seat back is normally biased to an upright position by the resilient articulating linkage 50 (solid lines in FIGS. 11A, 11B and 11C). The seat bottom is normally in a rearward position and the seat back in an upward position (FIG. 11A). The seat occupant can lean back, and the seat back will articulate rearwardly (dashed lines in FIG. 11A). Without leaning back against the upper part of the seat back but by pushing the buttocks forward, the seat bottom can be moved forwardly, pulling the seat back downwardly with it (solid lines, FIGS. 11B and 11C). By both leaning back against the seat back and pushing forward on the seat bottom, the occupant can assume a "relaxed-reclined" posture (FIG. 11C, dotted lines). The seat back can assume any position between the fully upright and the maximum rearward-tilting, and the seat bottom/back can move to any position between full rearward/upward and full forward/downward. The full forward/downward position of the seat bottom/back is established by engagement of the shoulder 68 of the casing 44 with the upper end of the upper linkage member 48 of the linkage 50 (See FIG. 13). The range of seating postures is, of course, further extended when the seat 14 (in its entirety) is supported by a mounting mechanism that provides tilt forward and tilt back.

Figure 9:
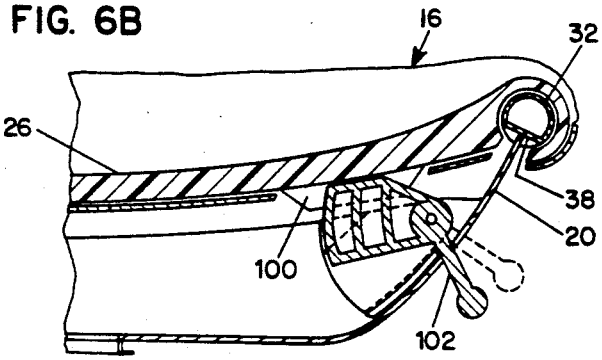
FIG. 9 is a partial front cross-sectional view of the seat bottom, seat support and cross-member of the embodiment.

As an optional but desirable feature, the chair can have a device for locking the seat/back in either the backward/upward mode or the forward/downward mode. For example, as shown in FIG. 9, an abutment 100 can be formed on or attached to the underside of the seat bottom component 26 and a lever 102 attached to the flame cross member 20. The position and front-to-rear width of the abutment 100 are such that in the backward/upward mode the lever 102 engages the front edge of the abutment and keeps the seat bottom from sliding forwardly and in the forward/downward mode the lever engages the rear edge of the abutment and prevents the seat bottom from sliding rearwardly. The lever 102 can, of course, be disengaged fully.

Figure 10A:
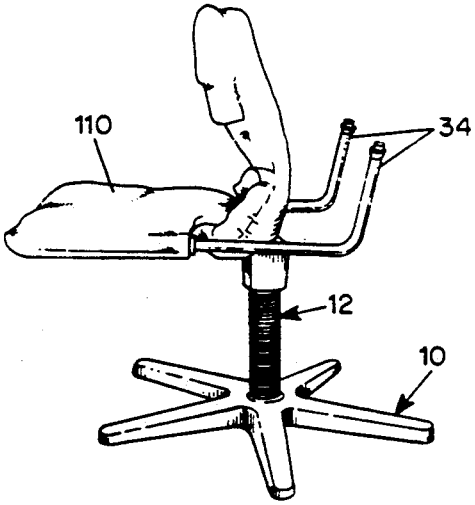
FIGS. 10A to 10F, inclusive, are pictorial views showing the sequence of steps carried out to assemble the embodiment.
Figure 10B:
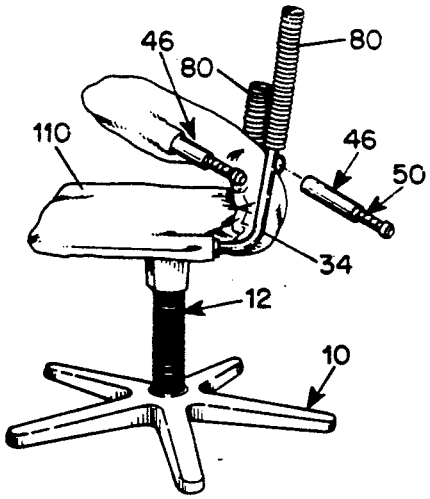
Figure 10D:
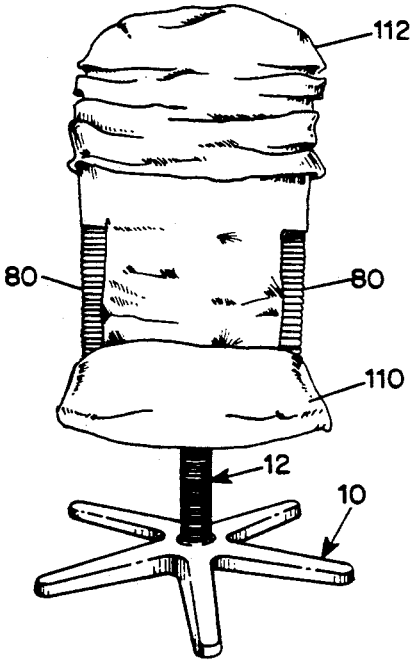
Figure 10C:
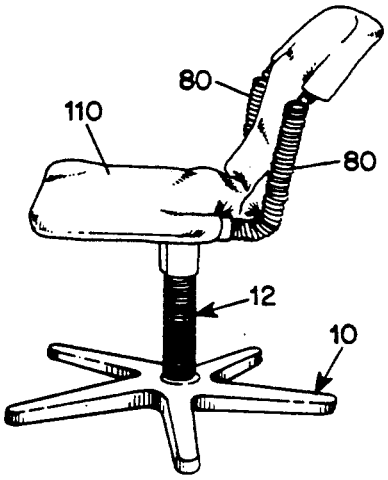
Figure 10E:
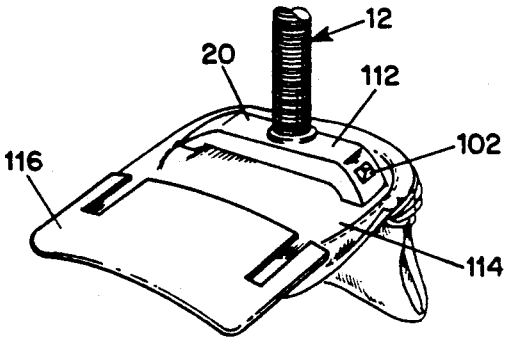
Figure 10F:
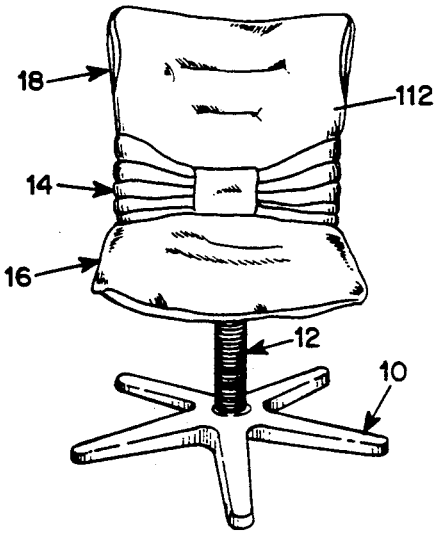

In the "Vertebra ®" seating the seat bottom and seat back are separately assembled to the frame and in upholstered versions are separately upholstered. Chairs based on the present invention can be built in similar models. In fully upholstered models (FIGS. 1 to 5) it might be thought that assembly procedures will be complicated. Not so, as seen in FIGS. 10A to 10F. Foam or other padding in an upholstery liner 110 is fitted to the seat bottom and back, and the seat bottom is then slid onto the side frame tubes 34 (FIG. 10A). The coupling members 80 are slipped over the frame tubes, and the linkage/configuration control spring sub-assemblies 46/50 are installed in the sockets of the seat back (FIG. 10B). Because the lower linkage members 52 are short (see FIG. 12) and the upholstery is flexible, there is not the slightest difficulty in installing the members 52 in the frame tubes 34 (FIG. 10C) and connecting up the coupling members (FIG. 10D). The outer upholstery is like a sock (FIG. 10D) and has an opening 114 on the underside of the seat bottom (FIG. 10E). It is pulled down over the seat back, forward over the seat bottom and down around the front and sides of the seat bottom and is fastened to the underside of the seat bottom around the opening 114. A shield piece 116 is then fastened to the underside of the seat bottom (FIG. 10E).

Figure 14:
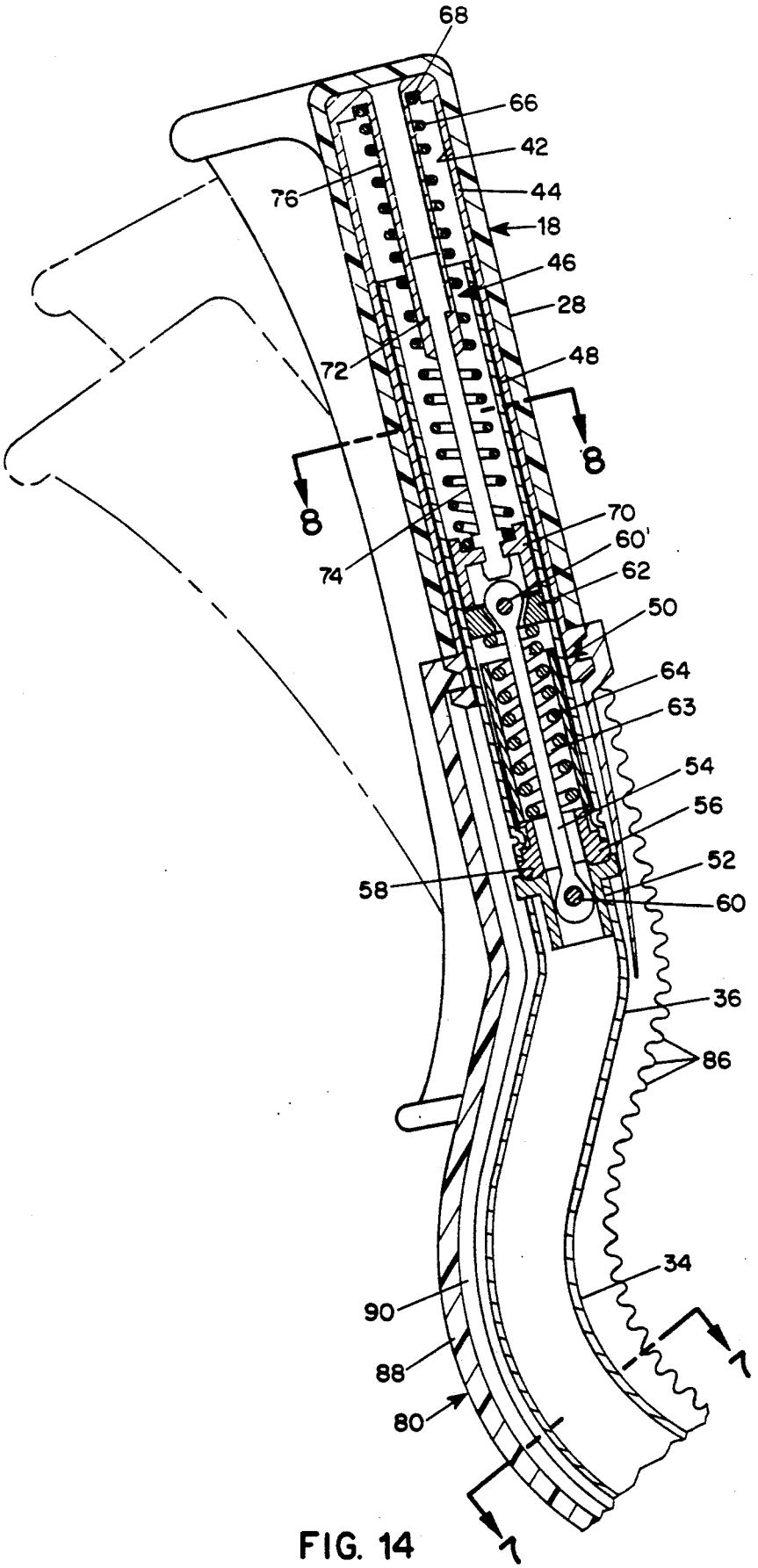
FIG. 14 is a side cross-sectional view of the seat back, the articulating mechanism and configuration control spring mechanism on a larger scale than FIG. 6A.
Figure 15:
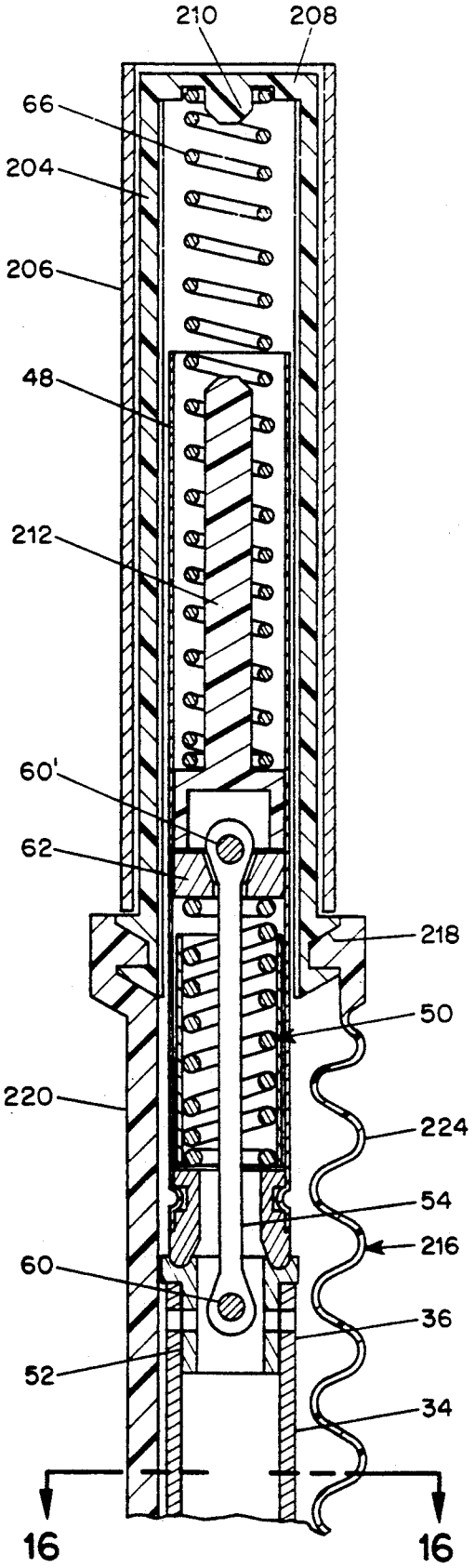
FIG. 15 is a side-cross-sectional view of a modified articulating mechanism and configuration control spring mechanism.

Instead of providing a configuration control spring mechanism for biasing the seat/back to the rearward/-upward position as an assembly that includes a casing, a stop tube and a stop rod, the configuration control spring can be installed in each socket in the back component at the time of assembly of the chair. In FIG. 15, which shows a modified design of the configuration control spring installation, the components that are the same as those of FIGS. 12 to 14 are designated by the same reference numerals. The lower tubular linkage member 52 is fastened to the upper end of the back-supporting portion 36 of the frame side tube 34 by rivets (not shown) and is pivotally connected by the pin 60 to the coupling rod 54, the other end of which is connected to the spring abutment member 62 by the pin 60'. The articulation control spring 63 is compressed between the abutment member 62 and the fitting 56, which is crimped to the lower end of the upper linkage member 48. So far, the modified design is the same as the one shown in FIGS. 12 to 14.

In the modified design of FIG. 15 each downwardly open socket 42 (not shown in FIG. 15 but see FIG. 14) of the seat back receives an anti-friction sleeve 204, which may be made from a polymeric material such as nylon and is, in turn, received within and affixed to a metal reinforcing tube 206, such as by a press-fit or an adhesive or both. The anti-friction sleeve has lengthwise ribs on its inner surface to provide a low-friction engagement with the outer surface of the upper linkage member. The tube 206 is press fit or adhesively secured (or both) in the socket 42 of the seat back. The anti-friction sleeve 204 has an end wall portion 208 at its upper end that includes a shoulder and boss portion 210 for retaining the upper end of the configuration control spring 66. After the resilient articulating linkage 50 is assembled to the frame side tube 34, a spring retainer/-guide member 212, which provides the dual functions of providing a seat for the spring 66 and of restraining the spring against lateral deflection into engagement with the inner wall of the upper linkage member 48, is placed within the upper linkage member 48, and the configuration control spring 66 of the spring mechanism is placed (without compressing it) over the member 212. The retainer/guide member is preferably made of a low-friction material, such as a polymeric material, to minimize friction between it and the spring. With the configuration control springs in place within the upper linkage members on both sides of the seat back, the seat back is slid down onto the upper linkage members 48 and pressed down far enough against the bias of the configuration control springs 66 to enable the upper ends of the coupling members 216 to be fastened in grooves 218 on the lower, outer ends of the anti-friction sleeves 204.

The lower/forward stop position of the seat back/-bottom in the design of FIG. 15 is established by engagement of the upper end wall 208 of each anti-friction sleeve 204 with the upper end of the corresponding upper linkage member 48. The upper/rearward stop position is established by engagement of the front end walls of the sockets 30 of the seat component 26 with the front ends of the corresponding seat-supporting portions 32 of the side frame tubes 34 (see FIG. 6B).

Figure 16:
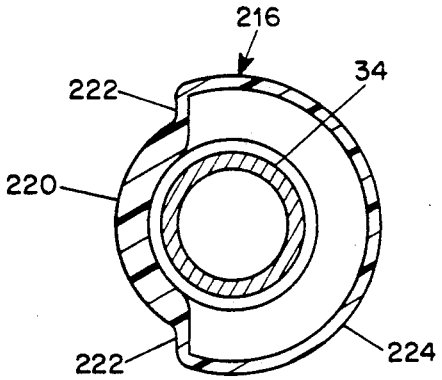
FIG. 16 is an end cross-sectional view of a modified coupling member that is part of the modified chair shown in FIG. 15, the cross section being taken along the lines 16—16 of FIG. 15.

As shown in FIGS. 15 and 16, the coupling members 216 of the modified chair of FIG. 15 differ slightly from those of FIG. 14 in that they have a rear wall portion 220 of substantially uniform thickness and tab portions 222 that extend laterally out from either side of the wall portion 220 to provide junctures with the corrugations of a corrugated or bellows-like front wall portion 224. The rear wall portion 220 is bendable but substantially non-extensible so that it can transmit forces between the seat bottom and the seat back to provide the coordinated forward/downward and rearward/upward movements of the bottom/back.

It is conceivable that the upper linkage members can be received directly in sliding and guiding relation within the sockets of the seat back and that the anti-friction sleeves and the reinforcing tubes can be omitted from the modified mechanism of FIG. 15. It is preferred, however, to strengthen the sockets of the seat back for assurance that they will not break and provide the anti-friction sleeve for a low-friction, metal-plastic sliding relationship between the seat back and the upper linkage member. It will also be readily apparent that the embodiment of FIGS. 12 to 14 can be modified to add an anti-friction sleeve between the tubular casing 44 and the upper linkage member 48 or to provide a low-friction coating on the casing 44 or the linkage member 48.

The principles of the present invention, as embodied in the example shown in the drawings, can be applied in various ways. For example a single frame member or two closely spaced frame members at the center of the seat can be used, according to embodiments of the Ambasz '850 patent. Other designs of resilient articulating linkages may be substituted for the linkage 50. Those and other variations and modifications will be readily apparent to those skilled in the art.

I claim:

1. Adjustable seating having a frame that includes a seat-supporting portion and a back-supporting portion, a seat bottom mounted on the seat-supporting portion for sliding movement between rearward and forward positions, and a seat back mounted on the back-supporting portion by at least one resilient articulating linkage for tilting movement in all positions of and independently of the position of the seat bottom between a resiliently restrained upright position and a tilted-back position, characterized in that the seat back is mounted on an upper linkage member of the resilient articulating linkage to slide up and down relative to the back-supporting portion of the frame, in that a bendable but substantially non-extensible coupling member connects the seat back to the seat bottom, in that the coupling member is constrained to follow a predetermined path from the seat back to the seat bottom, and in that a configuration control spring is engaged under compression between the seat back and the back-supporting portion of the frame and yieldably biases the seat back to an upward position and in so doing yieldably biases the seat bottom to its rearward position by means of the coupling member, whereby when the seat bottom is moved forwardly or rearwardly, the seat back moves downwardly or upwardly in correspondence with the forward and rearward movements of the seat bottom.

2. Adjustable seating according to claim 1 wherein the seat back includes a downwardly opening socket receiving the upper linkage member of the resilient articulating linkage and further characterized in that the upper linkage member is tubular and is received in the socket in sliding and guiding relation and in that the configuration control spring is received within the socket and the upper linkage member and is compressed between a shoulder in the top of the socket and a spring retainer member received within the upper linkage member.

3. Adjustable seating according to claim 2 and further characterized in that the spring retainer member includes a guide portion that receives a portion of the configuration control spring and constrains it laterally against deflection into engagement with the upper linkage member.

4. Adjustable seating according to claim 2 and further characterized in that a reinforcing member is received within and affixed to the socket of the seat back.

5. Adjustable seating according to claim 4 and further characterized in that an anti-friction sleeve of a polymeric material is received within and affixed to the reinforcing member in sliding and guiding relation to the upper linkage member.

6. Adjustable seating according to claim 4 and further characterized in that the coupling member is attached to the anti-friction sleeve.

7. Adjustable seating according to claim 4 and further characterized in that the reinforcing member is a tubular casing, the configuration control spring is received in the casing and the shoulder is formed on the casing.

8. Adjustable seating according to claim 7 and further characterized in that the tubular casing receives telescopically within it the upper linkage member in sliding and guiding relation.

9. Adjustable seating according to claim 2 and further characterized in that the seat-supporting and back-supporting portions of the frame are parts of a frame side member that is generally L-shaped in lateral profile and that the coupling member is tubular and is slidably received over the frame side member such that the frame side member constrains it to a predetermined path of movement.

10. Adjustable seating according to claim 2 and further characterized in that the upper linkage member has a lower edge seated on the upper edge of a tubular lower linkage member, in that the lower end of a coupling rod is pivotally attached to the lower linkage member and extends upwardly within the upper linkage member, in that the upper end of the coupling rod is connected to a spring abutment member, and in that an articulation control spring is compressed between the abutment member and a shoulder on the upper linkage member below the abutment member so as to yieldably bias the lower edge of the upper linkage member against the upper edge of the lower linkage member and thereby yieldably restrain the seat back in an upright position.

11. Adjustable seating according to claim 10 and further characterized in that the retainer member engages the spring abutment member, whereby the force of the configuration control spring is transmitted to the side frame tube by the coupling rod.

12. Adjustable seating according to claim 1 and further characterized in that a spring guide member receives a portion of the configuration control spring and constrains it laterally against deflection into engagement with the upper linkage member.

13. Adjustable seating according to claim 1 and further characterized in that there is a first stop means for establishing an uppermost position of the seat back and a rearward-most position of the seat bottom and a second stop means for establishing a lowermost position of the seat back and a forward-most position of the seat bottom.

14. Adjustable seating according to claim 1 and further characterized in that the seat-supporting and back-supporting portions of the frame are parts of a single frame member that is generally L-shaped in lateral profile and in that the coupling member is tubular and is received over the frame member such that the frame member constrains it to the predetermined path of movement.

15. Adjustable seating according to claim 1 and further characterized in that there is a means for selectively and releasably coupling the seat bottom to the frame in either its rearward position or its forward position such as to establish a fixed configuration of the seat bottom and seat back on the frame.

16. Adjustable seating according to claim 15 and further characterized in that the seat bottom coupling means includes an abutment on the underside of the seat member and a movable latch member on the frame movable to engage either a front edge or a rear edge of the abutment.

* * * * *